US006872056B2

(12) United States Patent
Stiefel

(10) Patent No.: US 6,872,056 B2
(45) Date of Patent: Mar. 29, 2005

(54) RADIAL PISTON PUMP FOR PRODUCING HIGH FUEL PRESSURE, AS WELL AS METHOD FOR OPERATING AN INTERNAL COMBUSTION ENGINE, COMPUTER PROGRAM, AND CONTROL AND/OR REGULATING UNIT

(75) Inventor: Hans-Peter Stiefel, Ditzingen (DE)

(73) Assignee: Robert Bosch GmbH, Stuttgart (DE)

( * ) Notice: Subject to any disclaimer, the term of this patent is extended or adjusted under 35 U.S.C. 154(b) by 34 days.

(21) Appl. No.: 10/216,352

(22) Filed: Aug. 12, 2002

(65) Prior Publication Data

US 2003/0031568 A1 Feb. 13, 2003

(30) Foreign Application Priority Data

Aug. 10, 2001 (DE) ..... 101 39 519

(51) Int. Cl.[7] ..... F04B 1/06; F02M 37/04

(52) U.S. Cl. ..... 417/221; 417/273; 123/500

(58) Field of Search ..... 417/221, 222.1, 417/273, 454; 92/13; 123/456, 446, 458, 500, 510; 91/505, 506

(56) References Cited

U.S. PATENT DOCUMENTS 2,900,839 A * 8/1959 Mackintosh ..... 74/571 M
3,682,572 A * 8/1972 Yarger ..... 417/273
6,016,791 A * 1/2000 Thomas et al. ..... 123/497
6,454,544 B2 * 9/2002 Palesch et al. ..... 417/221

FOREIGN PATENT DOCUMENTS

| | | | |
|---|---|---|---|
| DE | 195 23 282 A1 | | 6/1995 |
| DE | 197 05 205 A1 | | 2/1997 |
| DE | 198 58 862 A1 | | 12/1998 |
| DE | 199 61 558 A1 | | 12/1999 |
| DE | 199 56 092 A1 | * | 10/2000 |
| JP | 3-111673 A | * | 5/1991 |
| JP | 7-180650 A | * | 7/1995 |

* cited by examiner

*Primary Examiner*—Charles G. Freay
(74) *Attorney, Agent, or Firm*—Ronald E. Greigg

(57) ABSTRACT

A radial piston pump used for producing high fuel pressure in fuel systems of internal combustion engines, in particular in a common rail injection system includes a housing with at least one cylinder and a drive shaft is supported in the housing and having at least one cam section. A stroke ring is disposed encompassing the cam section a piston contained in each cylinder is supported against the stroke ring. A possibility for adjusting the delivery quantity of the radial piston pump is achieved in that an adjusting ring is disposed between the cam section and the stroke ring and the internal opening of this adjusting ring is eccentric in relation to the outer contour and can be rotated around the central axis of the internal opening into a desired angular position in relation to the cam section.

18 Claims, 4 Drawing Sheets

RADIAL PISTON PUMP FOR PRODUCING HIGH FUEL PRESSURE, AS WELL AS METHOD FOR OPERATING AN INTERNAL COMBUSTION ENGINE, COMPUTER PROGRAM, AND CONTROL AND/OR REGULATING UNIT

BACKGROUND OF THE INVENTION

1. Field of the Invention

The invention relates first to a radial piston pump for producing high fuel pressure in fuel systems of internal combustion engines, in particular in a common rail injection system, with a housing that has at least one cylinder, with a drive shaft that is supported in the housing and has at least one cam section, with a stroke ring that is disposed encompassing the cam section, and with at least one piston that is contained in the cylinder and is supported against the stroke ring.

2. Description of the Prior Art

A radial piston pump of the type with which this invention is concerned is known from DE 198 58 862 A1. In it, three cylinders are arranged in the form of a star around a cam section of a central drive shaft. A stroke ring is placed onto the cam section and is connected to the radially inner ends of the pistons contained in the cylinders. The stroke ring itself does not rotate, but moves along a circular path in its plane. This sets the pistons contained in the cylinders into a reciprocating motion.

A radial piston pump of this kind is used as a high-pressure fuel pump in a fuel system. It is supplied with fuel by a presupply pump and it sends the fuel on into a fuel accumulation line, also commonly referred to as a "rail". From there, the fuel travels through injectors into combustion chambers of the engine.

In certain operating situations, it can be necessary to vary the quantity of fuel delivered by the high-pressure fuel pump to the fuel accumulation line. Usually, pressure control valves and/or quantity control valves are provided for this. Their operation causes pressure surges in the low-pressure region, which makes it necessary to install pressure dampers. Furthermore, the fuel accumulation line is provided with a pressure relief valve via which excess fuel delivered by the high-pressure fuel pump can be discharged from the fuel accumulation line.

OBJECT AND SUMMARY OF THE INVENTION

The object of the current invention is to modify a radial piston pump of the type mentioned above so that the fuel system in which it is used can be more simply and inexpensively produced.

This object is attained in a radial piston pump by disposing an adjusting ring between the cam section and the stroke ring; the internal opening of this adjusting ring is eccentric in relation to the outer contour and can be rotated around the central axis of the internal opening into a desired angular position in relation to the cam section.

An essential advantage of the radial piston pump according to the invention lies in the fact that pressure control valves or quantity control valves are no longer required to control the fuel quantity that is delivered. Instead, the quantity is controlled by adjusting the stroke of the piston or pistons of the radial piston pump. The radial piston pump according to the invention is therefore simpler in design.

In addition, when only a small fuel quantity is to be delivered by the radial piston pump, only a correspondingly low torque on the drive shaft is required. Since the quantity control valves that were previously present generated considerable pressure surges in the low-pressure region of the fuel injection system, it was previously necessary to provide at least one pressure damper in the low-pressure region of the fuel system. This, too, can be eliminated through the use of the radial piston pump according to the invention.

Since the fuel quantity delivered by the radial piston pump can be very precisely adjusted, the pressure relief valve provided in the fuel accumulation line and corresponding return can be made smaller or if need be, such a pressure relief valve can be eliminated entirely. The use of the radial piston pump according to the invention also permits the elimination of an overflow line leading back to the fuel tank, for example. The radial piston pump according to the invention consequently reduces costs in the construction of a fuel system and the fuel system as a whole is more simply designed because it includes fewer components.

In a first advantageous modification of the radial piston pump according to the invention, the pump includes an adjusting shaft, which cooperates with the adjusting ring by means of a gearing. An adjusting shaft of this kind can be accommodated in a space-saving manner in the radial piston pump and permits reliable and precise adjustments to the adjusting ring.

In this connection, it is particularly preferable if the adjusting shaft is disposed coaxial to the rotation axis of the drive shaft and at one end of the cam section of the drive shaft, eccentric to the rotation axis of the drive shaft, a gear is provided, which cooperates on the one hand with an external gearing on the adjusting shaft and on the other hand, cooperates with an internal gearing in the adjusting ring. This produces an adjusting device for the adjusting ring, which on the one hand is compact and on the other hand, due to the gear disposed between the adjusting shaft and the adjusting ring, permits there to be a favorable transmission ratio or possibly a self-locking between the adjusting ring and the adjusting shaft.

A particularly preferable embodiment is the one in which the eccentricity of the internal opening of the adjusting ring and the eccentricity of the cam section of the drive shaft are essentially the same. This geometric design makes it possible, through an appropriate adjustment of the adjusting ring, to produce a zero-delivery of the radial piston pump because in a particular angular position of the adjusting ring, the eccentricity of the cam section of the drive shaft is compensated by the eccentricity of the internal opening of the adjusting ring. In this instance, even when the drive shaft is rotating, the pistons of the radial piston pump remain essentially still.

In this connection, it is particularly preferable if a stop is provided on the adjusting ring and defines an angular position of the adjusting ring in relation to the drive shaft such that the stroke ring is at least approximately coaxial to the rotation axis of the drive shaft. In this angular position of the adjusting ring, which is defined by the stop, the radial piston pump operates at zero-delivery. The stop defines this operating point of the radial piston pump in a simple manner.

The stop can be produced by virtue of the fact that the internal gearing on the adjusting ring extends in the circumferential direction over a range of approximately 185° to 195°, preferably over a range of approximately 190°, and the internal gearing is symmetrical in relation to an axis, which lies in the plane of the adjusting ring, extends through the center of the internal opening of the adjusting ring, and is orthogonal to the symmetry axis of the adjusting ring.

Therefore, the stop is constituted only by the disposition and embodiment of the internal gearing on the adjusting ring so that an additional stop element can be eliminated.

Preferably, an electric adjusting device is provided, which acts on the adjusting shaft. A device of this kind is easy to activate. The electric adjusting device can include an electric motor, preferably a stepping motor. It is possible to accommodate corresponding supply lines in a space-saving manner. Furthermore, an electric adjusting device, in particular a stepping motor, operates in a very precise manner and is relatively compact. In principle, however, it is also conceivable to use an electromagnetic or hydraulic actuator.

If an electric motor is used to adjust the adjusting shaft, the invention proposes that the stator of the electric motor be non-rotatably connected to the drive shaft and that the rotor of the electric motor be non-rotatably connected to the adjusting shaft. Normally, when no adjusting procedure is in the process of occurring, the drive shaft, the adjusting shaft, and correspondingly the stator and rotor of the electric motor, rotate synchronously. But when an adjustment of the adjusting ring is required, the device according to the invention can simply cause there to be a speed difference between the drive shaft and the adjusting shaft, which produces an adjustment of the adjusting ring.

The invention also relates to a method for operating an internal combustion engine in which the fuel is at least also delivered by a radial piston pump with a housing that has at least one cylinder, with a drive shaft that is supported in the housing and has at least one cam section, with a stroke ring that is disposed encompassing the cam section, and with at least one piston that is contained in the cylinder and is supported against the stroke ring.

In order to simplify the design of the engine, the invention proposes that the eccentricity of the stroke ring be adjusted in relation to the rotation axis of the drive shaft as a function of at least one operating parameter of the engine.

With the method according to the invention, the fuel quantity delivered by the radial piston pump can therefore be adapted very rapidly to a change in the operating state of the engine. This makes it possible to deliver to the fuel accumulation line essentially only the fuel quantity that will then be conveyed by the injectors into the combustion chambers. The otherwise customary return of excess fuel from the fuel accumulation line can therefore be eliminated or the components required for this can at least be made smaller.

An advantageous modification to this proposes that before the starting of the engine, the adjusting ring be moved against a mechanical stop, which defines an angular position of the adjusting ring in relation to the drive shaft in which the stroke ring is at least essentially approximately coaxial to the rotation axis of the drive shaft, and that a balancing of the control electronics be executed in this position. This modification of the method according to the invention has the advantage that before each start of the engine, the control electronics can be adjusted to the zero position of the adjusting ring precisely predetermined by the mechanical stop. This increases the precision in the adjustment of the adjusting ring and consequently increases the precision in the adjustment of the fuel quantity delivered by the radial piston pump.

The essential parameters for the fuel quantity to be delivered by the radial piston pump are the desired torque and the current speed of the engine. This fact is taken into account in the modification of the method according to the invention in which, based on the desired torque and speed of the engine, a parameter is determined, which is required for adjusting an eccentricity of the stroke ring in relation to the rotation axis of the drive shaft in which the radial piston pump delivers the fuel quantity that corresponds to the desired torque and speed.

The invention also relates to a computer program, which is suitable for executing the method mentioned above when it is run on a computer. It is particularly preferable if the computer program is stored in a memory, in particular a flash memory.

Another subject of the invention is a control and/or regulating unit for controlling and/or regulating at least one function of an internal combustion engine. With a control and/or regulating unit of this kind, it is advantageous if it is provided with a computer program of the type mentioned above.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
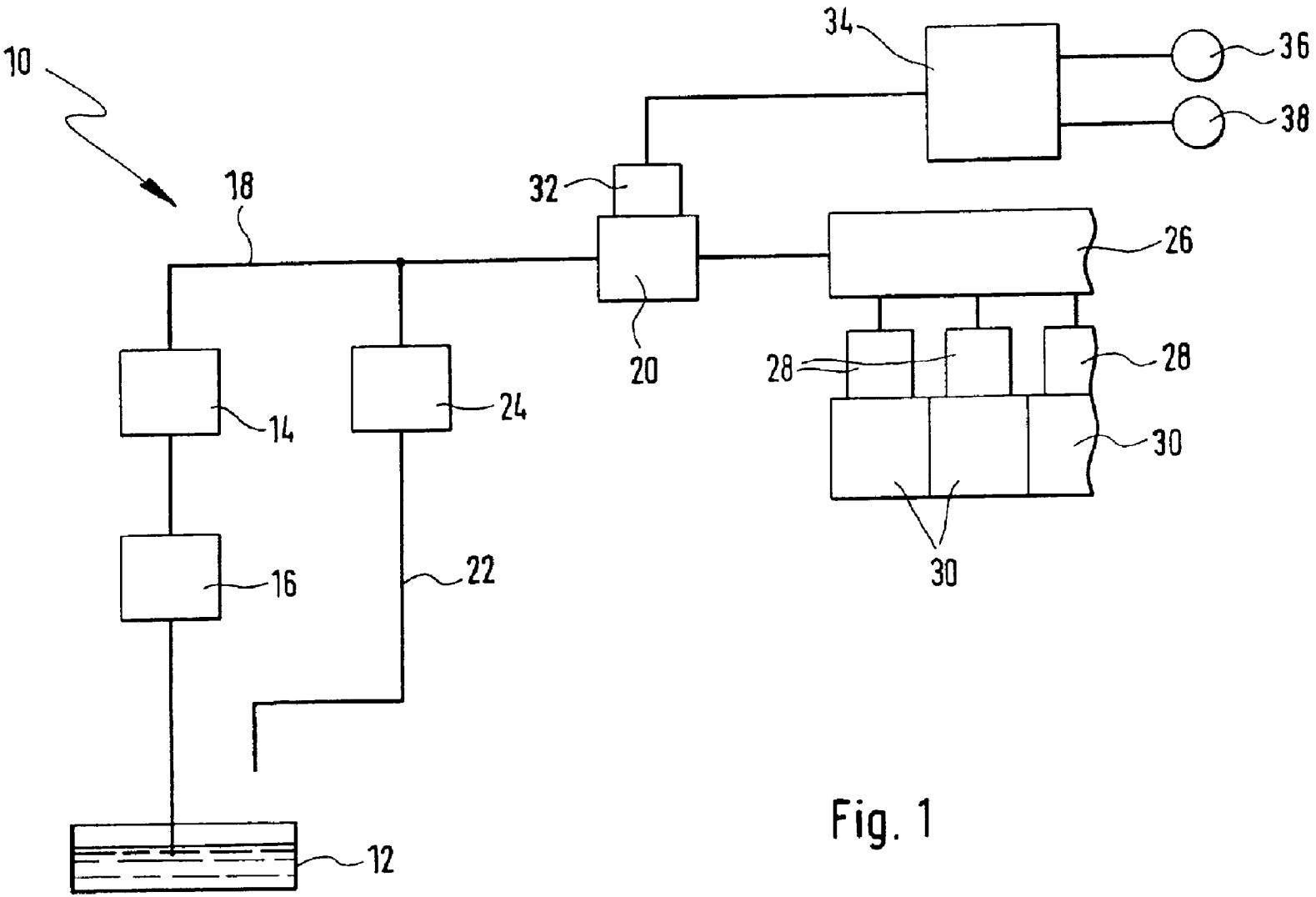
FIG. 1 shows a schematic representation of a fuel system with a radial piston pump.

In FIG. 1, a fuel system is labeled with the reference numeral 10. It includes a fuel tank 12 from which an electric fuel pump 14 delivers fuel by means of a filter 16. A low-pressure fuel line 18 connects the electric fuel pump 14 to a high-pressure fuel pump 20. A branch line 22, which contains a pressure regulating valve 24, branches from the low-pressure fuel line 18, between the electric fuel pump 14 and the high-pressure pump 20.

The high-pressure fuel pump 20 delivers the fuel into a fuel accumulation line 26, in which the fuel is stored under very high-pressure. The accumulation line 26 is connected to a number of injectors 28, which inject the fuel directly into combustion chambers 30.

As will be explained in detail further below, the fuel quantity delivered by the high-pressure fuel pump 20 to the fuel accumulation line 26 can be changed. To this end, the high-pressure fuel pump 20 includes an electric motor 32, which is activated by a control and/or regulating unit 34. This control and/or regulating unit 34 is connected on the input side to a sensor 36 that detects the speed of the engine and a sensor 38 that generates signals, which correspond to a reference torque of the engine.

The precise design of the high-pressure fuel pump 20 will now be explained with reference to FIGS. 2 and 3. The high-pressure fuel pump 20 is a radial piston pump with three cylinders 40*a*, 40*b*, and 40*c* arranged in the form of a star (FIG. 3). The cylinders, 40*a*, 40*b*, and 40*c* are closed toward the radial outside by cylinder heads 42*a*, 42*b*, and 42*c* containing bushings 44*a*, 44*b*, and 44*c* that accommodate the pistons 46*a*, 46*b*, and 46*c* in a sliding fashion.

The cylinders 40*a*, 40*b*, and 40*c* are part of a housing 48. A drive shaft 50 is contained in the center of the housing 48 between the cylinders 40*a*, 40*b*, and 40*c*. This drive shaft 50 is connected by means of a clutch 52 to a camshaft (not shown) of the engine. The left end of the drive shaft 50 in FIG. 2 is supported in relation to the housing 48 by means of a ball bearing 53.

Figure 5:
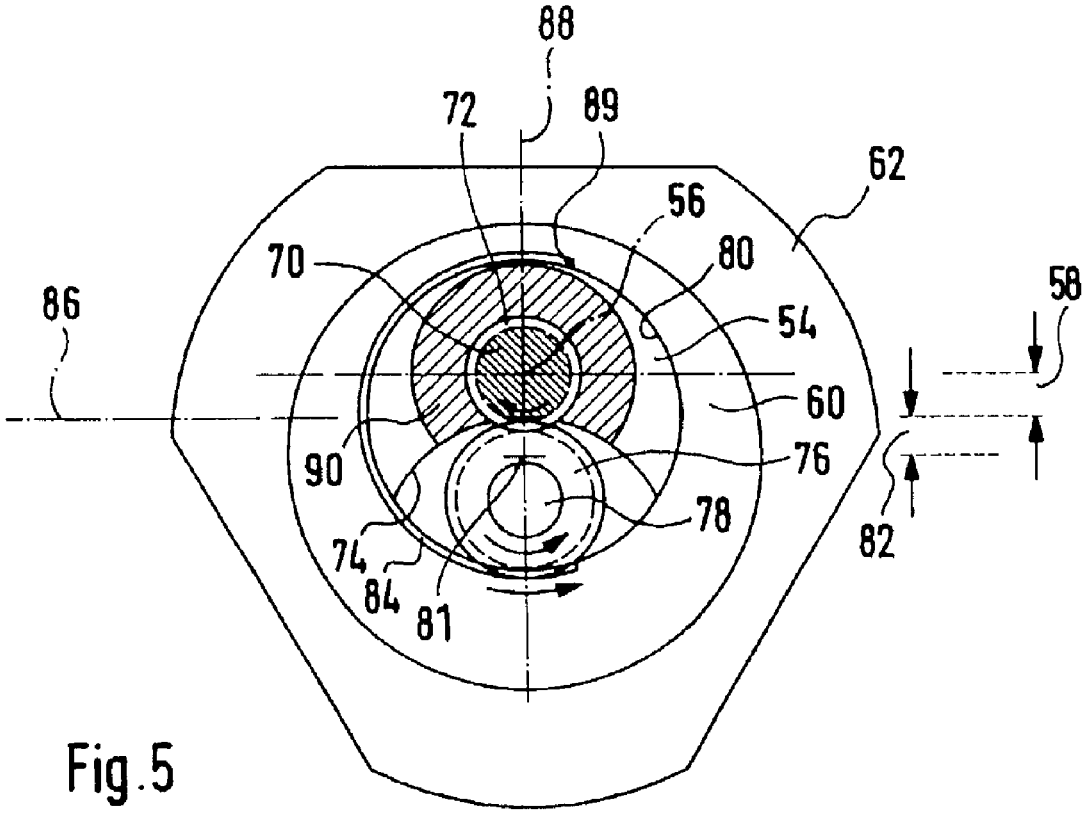
FIG. 5 shows a view similar to FIG. 4 in an operating state of the radial piston pump in which it is delivering the maximal possible fuel quantity.

In the vicinity of the cylinders 40*a*, 40*b*, and 40*c*, the drive shaft 50 has a cam section 54. This cam section is offset in relation to the rotation axis 56 of the drive shaft 50 by an eccentricity 58 (FIG. 5). An adjusting ring 60 is placed onto the radial outside of the cam section 54 of the drive shaft 50. A stroke ring 62 is in turn placed onto the radial outside of the adjusting ring 60. Around its stroke ring bore 63, the stroke ring 62 has a circumferential collar 65 extending radially inward. This collar secures the stroke ring 62 axially between the adjusting ring 60 and a shaft collar 67 provided on the drive shaft 50.

The outer circumferential surface of the stroke ring 62 has three flattened regions 64*a*, 64*b*, and 64*c* offset from one another by 120°. A sliding block 66*a*, 66*b*, and 66*c* is pressed against this flattened region by means of a spring 68*a*, 68*b*, and 68*c* that is supported against the bushing 44*a*, 44*b*, and 44*c*. The sliding block 66*a*, 66*b*, and 66*c* is connected to the radially inner end of the piston 46*a*, 46*b*, and 46*c*.

Figure 2:
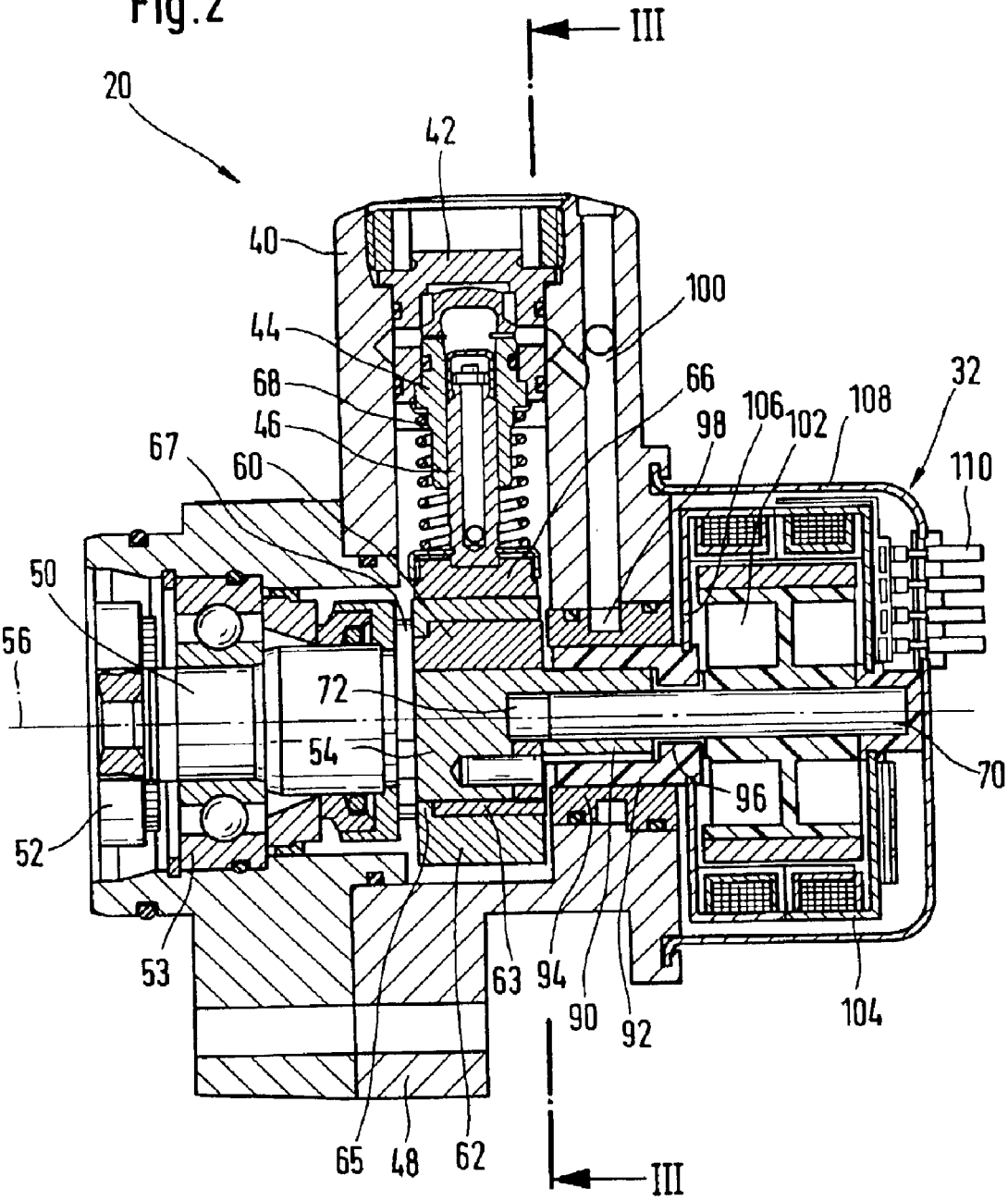
FIG. 2 shows a partially sectional view of the radial piston pump from FIG. 1.
Figure 3:
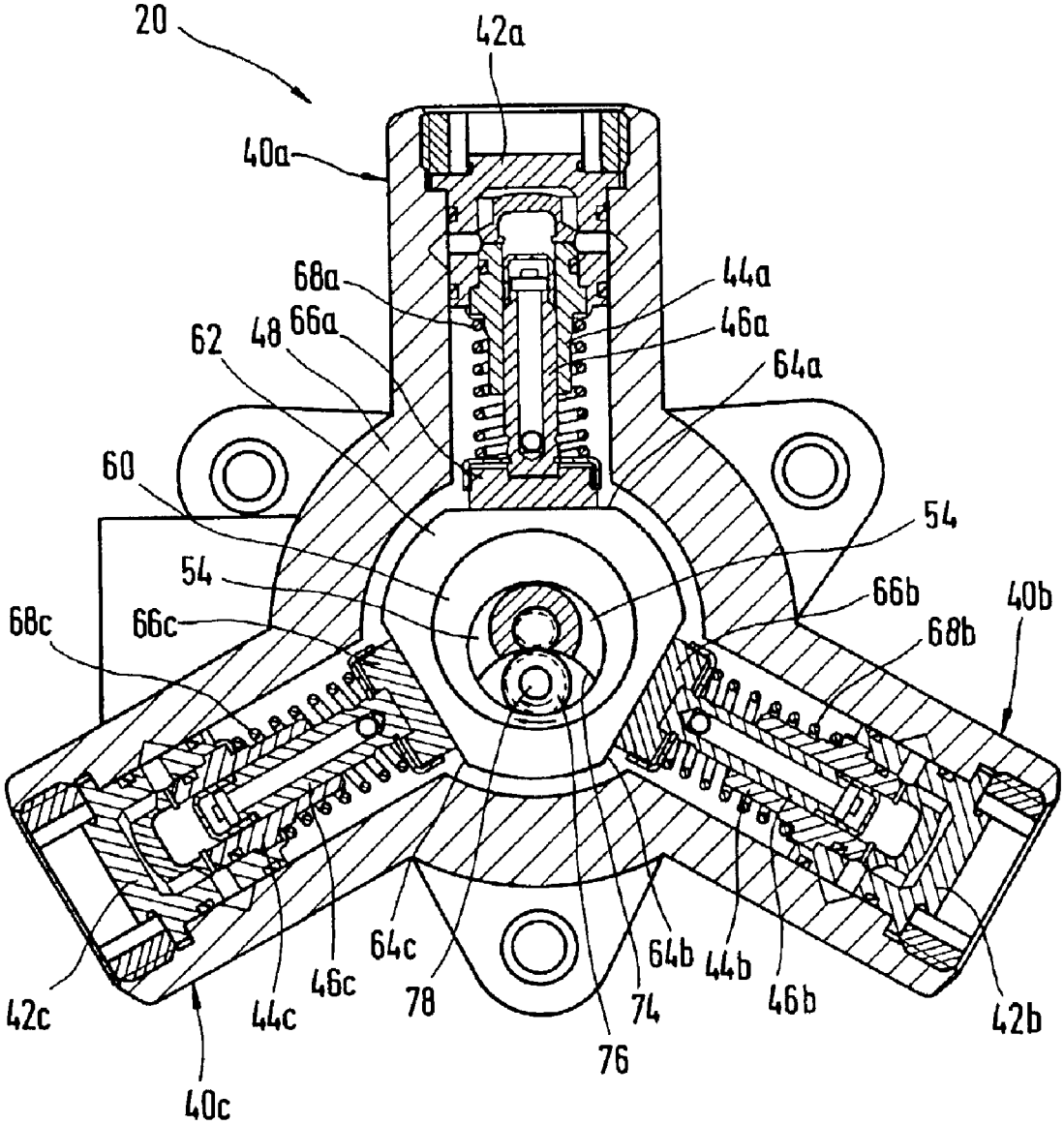
FIG. 3 shows a sectional depiction along the line III—III of the radial piston pump from FIG. 2.

In its region on the right hand side in FIG. 2, the drive shaft 50 is embodied as having an axial recess formed therein. An adjusting shaft 70 is inserted into this recess. At its end on the left in FIG. 2, the adjusting shaft 70 supports a circumferential gearing 72.

Figure 4:
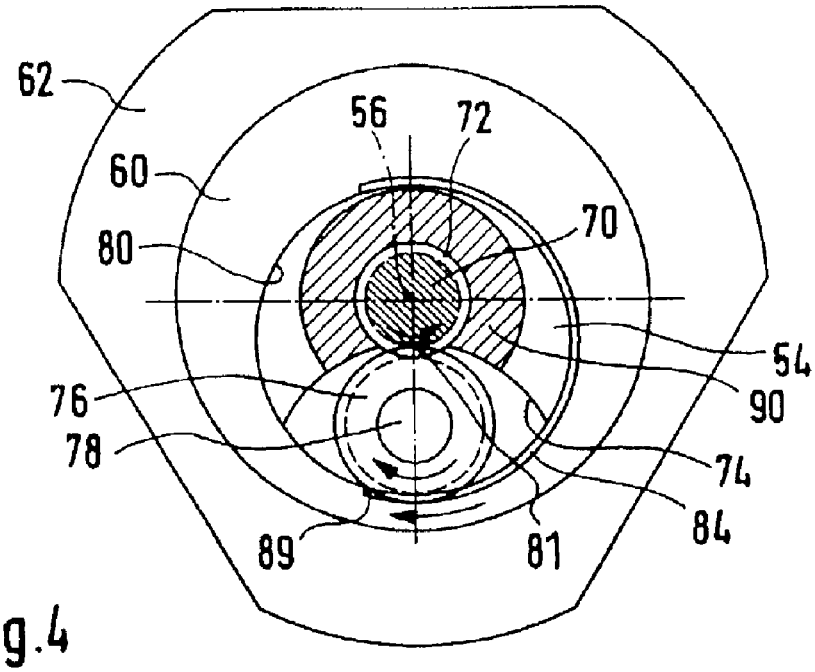
FIG. 4 shows a detail of the radial piston pump from FIG. 3, in an operating state of the radial piston pump in which it is not delivering any fuel.

In the end of the cam section 54 of the drive shaft 50 on the right in FIG. 2, there is a milled section 74 in the region of the greatest eccentricity 58. This milled section contains a gear 76, which is supported so that it can rotate around an axle 78 fastened in the cam section 54. The gear 76 engages with the gearing 72 on the adjusting shaft 70. The adjusting ring 60 is placed with an internal opening 80 onto the cam section 54 of the drive shaft 50 (FIGS. 4 and 5).

The central axis 81 of the internal opening 80 is disposed offset from the circular outer contour of the adjusting ring 60 by an eccentricity 82 (FIG. 5). In a region of the inner circumferential surface of the internal opening 80 of the adjusting ring 60, an internal gearing 84 is provided. The gear 76 also engages with this internal gearing 84. The internal gearing 84 on the adjusting ring 60 extends in the circumferential direction over a range of approximately 190°. The internal gearing 84 is symmetrical in relation to an axis 86, which lies in the plane of the adjusting ring 60, extends through the center 81 of the internal opening of the adjusting ring, and is orthogonal to the symmetry axis 88 of the adjusting ring 60 (FIG. 5). As will be explained further below, the ends of the internal gearing constitute stops, which are labeled with the reference numeral 89 in FIGS. 4 and 5.

In FIG. 2, a shaft journal 90 extends toward the right from the cam section 54 of the drive shaft 50. A bearing bush 92 is pressed-fitted onto it. The associated bearing ring 94 is pressed-fitted into the housing 48. The bearing bush 92 and the bearing ring 94 jointly comprise a slide bearing, which supports the right end of the drive shaft 50 in FIG. 2 in relation to the housing 48.

In order to assure that the bearing bush 92 cannot rotate in relation to the bearing journal 90, two diametrically opposed ribs 96 extend radially inward from the inner circumferential surface of the bearing bush 92 and engage in corresponding grooves (unnumbered) in the bearing journal 90. The outer circumferential surface of the bearing ring 94 is provided with an annular recess 98 into which a high-pressure bore 100 in the housing 48 feeds.

The adjusting shaft 70 simultaneously serves as the axle of the electric motor 32. In this connection, a rotor 102 of the electric motor 32 is non-rotatably fastened to the end of the adjusting shaft 70 on the right in FIG. 2. A stator 104 of the electric motor 32 encompasses the rotor 102. The stator 104 is non-rotatably connected to the bearing bush 92 by means of a disk-shaped securing plate 106. The disk-shaped securing plate 106 can be injection molded onto the bearing bush 92, for example. In this manner, the stator 104 is non-rotatably connected to the drive shaft 50. The stator 104 is encompassed by a covering hood 108, whose rim is flange-mounted in a pressure-tight manner in the housing 48. Plug contacts 110 are provided in the covering hood 108 and can supply current to the stator 104 by means of sliding contacts (unnumbered).

The fuel system 10 with the radial piston pump 20 operates as follows: before the starting of the engine, for example upon actuation of the ignition, the control and/or regulating unit 34 activates the electric motor 32 so that the gear 76 comes into contact with the stop 89 of the internal gearing 84 on the adjusting ring 60.

The adjusting ring 60 is adjusted by means of a relative rotation of the rotor 102 in relation to the stator 104. This also causes the adjusting shaft 70 and the gear 76 to rotate. This in turn leads to a relative rotation of the adjusting ring 60 in relation to the cam section 54 of the drive shaft 50.

As shown in FIG. 4, the adjusting ring 60 is then disposed in an angular position in relation to the drive shaft 50 such that the stroke ring 62 is coaxial to the rotation axis 56 of the drive shaft 50. The reason for this is that the eccentricity 58 is compensated by the eccentricity 82. In this position, if the drive shaft 50 were to be rotated, the stroke ring 62 would not move so that the pistons 46*a*, 46*b*, and 46*c* of the radial piston pump 20 would also not reciprocate. This position of the adjusting ring 60 consequently corresponds to a "zero-delivery" of the radial piston pump 20. Then a balancing of the control electronics in the control and regulating unit 34 takes place.

When the balancing is completed, the control and regulating unit 34 activates the electric motor 32 so that the adjusting ring 60 rotates a little further in relation to the cam section 54, causing the stop 89 of the internal gearing 84 to move a little further away from the gear 76. The stroke ring 62 is then no longer coaxial to the rotation axis of the drive shaft 50. If the engine is started now, which causes a rotation of the drive shaft 50, then the adjusting ring 60 rotates with the cam section 54 of the drive shaft 50, which produces a circular motion of the stroke ring 62. This motion of the stroke ring 62 in turn sets the pistons 46*a*, 46*b*, and 46*c* into an alternating reciprocating motion. Consequently, the high-pressure fuel pump 20 delivers fuel to the fuel accumulation line 26.

If the maximal output of the engine is required, which is detected by the sensors 36 and 38, the control and regulating unit 34 rotates the adjusting ring 60 into the position shown in FIG. 5. In this position of the adjusting ring 60, the eccentricity 58 of the cam section 54 of the drive shaft 50 is added to the eccentricity 82 of the internal opening 80 of the adjusting ring 60. The circular path on which the stroke ring 62 now moves during a rotation of the drive shaft 50 has a maximal radius so that the pistons 46*a*, 46*b*, and 46*c* execute the maximal stroke motion. Therefore the high-pressure fuel pump 20 now pumps the maximal possible fuel quantity.

It is clear that each angular position of the adjusting ring 60 in relation to the cam section 54 of the drive shaft 50 corresponds to a quite definite delivery rate of a high-pressure fuel pump 20. These angular positions and the associated delivery rates are stored in the control and regulating unit 34. The control and regulating unit 34 converts the yields of the engine that correspond to the desires of the user, in particular the torque and speed, into the required fuel quantity and the associated angular position of the adjusting ring 60 in relation to the cam section 54 of the drive shaft 50, and the electric motor 32 is correspondingly activated.

Since the electric motor 32 and the drive shaft 50 are non-rotatably connected to each other, the angular position of the adjusting ring 60 in relation to the cam section 54 changes only when the adjusting shaft 70 rotates at a different speed than the drive shaft 50. If a steady delivery rate is to be produced with the high-pressure fuel pump 20, then the drive shaft 50 and the adjusting shaft 70 rotate at the same speed.

The foregoing relates to preferred exemplary embodiments of the invention, it being understood that other variants and embodiments thereof are possible within the spirit and scope of the invention, the latter being defined by the appended claims.

I claim:

1. A radial piston pump (20) for producing high fuel pressure in a fuel system (10) of an internal combustion engine in particular in a common rail injection system, the pump comprising a housing (48) that has at least one cylinder (40*a,* 40*b,* and 40*c*);

a drive shaft (50) supported in the housing (48) and having at least one cam section (54), a stroke ring (62) disposed encompassing the cam section (54), at least one piston (46*a,* 46*b,* and 46*c*) contained one in each at least one cylinder (40*a,* 40*b,* and 40*c*) and supported against the stroke ring (62), an adjusting ring (60) disposed between the cam section (54) and the stroke ring (62), an internal opening (80) of this adjusting ring (60) being eccentric in relation to its outer contour, adjusting means for rotating the adjusting ring around a central axis (81) of the internal opening (80) into a desired angular position in relation to the cam section (54), said adjusting means comprising an adjusting shaft (70), which cooperates with the adjusting ring (60) by means of a gearing (72), and which is inserted coaxially to a rotation axis (56) of the drive shaft (50) within an axial recess formed in the drive shaft (50).

2. The radial piston pump (20) according to claim 1, wherein a gear (76) is provided on one end of the cam section (54) of the drive shaft (50), eccentric to the rotation axis (56) of the drive shaft (50), which gear cooperates on the one hand with an external gearing (72) on the adjusting shaft (70) and on the other hand, cooperates with an internal gearing (84) in the adjusting ring (60).

3. The radial piston pump (20) according to claim 1 wherein the eccentricity (82) of the internal opening (80) of the adjusting ring (60) and the eccentricity (58) of the cam section (54) of the drive shaft (50) are essentially the same.

4. The radial piston pump (20) according to claim 2 wherein the eccentricity (82) of the internal opening (80) of the adjusting ring (60) and the eccentricity (58) of the cam section (54) of the drive shaft (50) are essentially the same.

5. The radial piston pump (20) according to claim 3, further comprising a stop (89) on the adjusting ring (60), the stop defining an angular position of the adjusting ring (60) in relation to the drive shaft (50) in which the stroke ring (62) is at least approximately coaxial to the rotation axis (56) of the drive shaft (50).

6. The radial piston pump (20) according to claim 2 wherein the internal gearing (84) on the adjusting ring (60) extends in the circumference direction over a range of approximately 185° to 195°, preferably over a range of approximately 190°, and the internal gearing (84) is symmetrical in relation to an axis (86), which lies in the plane of the adjusting ring (62), extends through the center (81) of the internal opening (80) of the adjusting ring (60), and is orthogonal to the symmetry axis (88) of the adjusting ring (60).

7. The radial piston pump (20) according to claim 5 wherein the internal gearing (84) on the adjusting ring (60) extends in the circumference direction over a range of approximately 185° to 195°, preferably over a range of approximately 190°, and the internal gearing (84) is symmetrical in relation to an axis (86), which lies in the plane of the adjusting ring (62), extends through the center (81) of the internal opening (80) of the adjusting ring (60), and is orthogonal to the symmetry axis (88) of the adjusting ring (60).

8. The radial piston pump (20) according to claim 1 further comprising it includes an electrical adjusting device (32), which acts on the adjusting shaft (70).

9. The radial piston pump (20) according to claim 2 further comprising it includes an electrical adjusting device (32), which acts on the adjusting shaft (70).

10. The radial piston pump (20) according to claim 6 further comprising it includes an electrical adjusting device (32), which acts on the adjusting shaft (70).

11. The radial piston pump (20) according to claim 8, characterized in that the electrical adjusting device includes an electric motor (32), preferably a stepping motor.

12. The radial piston pump (20) according to claim 11, characterized in that the electric motor (32) comprises a stator (104) which is non-rotatably connected to the drive shaft (50) and a rotor (102) which is non-rotatably connected to the adjusting shaft (70).

13. A method for operating an internal combustion engine in which the fuel is delivered by means of a radial piston pump (20) with a housing (48) that has at least one cylinder 40*a,*40*b,* and 40*c*), with a drive shaft (50) that is supported in the housing (48) and has at least one cam section (54), with a stroke ring (62) that is disposed encompassing the cam section (54), and with at least one piston (46*a,*46*b,* and 46*c*) that is contained in the cylinder (40*a,* 40*b,* and 40*c*) and is supported against the stroke ring (62), the method comprising adjusting the eccentricity of the stroke ring (62) in relation to the rotation axis (56) of the drive shaft (50) as a function of at least one operating parameter of the engine, and wherein, based on a desired torque and speed of the engine, a parameter is determined, which is required for adjusting an eccentricity of the stroke ring (62) in relation to the rotation axis (56) of the drive shaft (50) such that the radial piston pump (20) delivers the fuel quantity that corresponds to the desired torque and speed of the engine, the method further comprising moving an adjusting ring (60) against a mechanical stop (81) before starting the engine, the stop (81) defining an angular position of the adjusting ring (60) in relation to the drive shaft (50) in which the stroke ring (62) is at least essentially approximately coaxial to the rotation axis (56) of the drive shaft (50) and that in this position, a balancing of the control electronics (34) is executed.

14. The method according to claim 13 wherein, based on a desired torque and speed of the engine, a parameter is determined, which is required for adjusting an eccentricity of the stroke ring (62) in relation to the rotation axis (56) of the drive shaft (50) such that the radial piston pump (20) delivers the fuel quantity that corresponds to the desired torque and speed.

15. A method for operating an internal combustion engine in which a fuel quantity is delivered by means of a radial piston pump (20) with a housing (48) that has at least one cylinder (40*a,* 40*b,* and 40*c*), with a drive shaft (50) that is supported in the housing (48) and has at least one cam section (54), with a stroke ring (62) that is disposed encompassing the cam section (54), and with at least one piston (46*a,* 46*b,* and 46*c*) that is contained in the cylinder (40*a*, 40*b,* and 40*c*) and is supported against the stroke ring (62), the method comprising adjusting an eccentricity of the stroke ring (62) in relation to the rotation axis (56) of the drive shaft (50) as a function of at least one operating parameter of the engine, and wherein the method further includes determining said at least one operating parameter, based on a desired torque and speed of the engine, which said at least one parameter is used to determine the eccentricity of the stroke ring (62) in relation to the rotation axis (56) of the drive shaft (50) such that the radial piston pump (20) delivers the fuel quantity that corresponds to the desired torque and speed of the engine.

16. A computer program, suitable for executing the method according to claim 15 when it is run on a computer.

17. The computer program according to claim 16, wherein the computer program is stored in a memory, in particular a flash memory.

18. A control and/or regulating unit (34) for controlling and/or regulating at least one function of an internal combustion engine, the control unit comprising a computer program suitable for activating a method according to claim 15.

* * * * *